US008633794B2

(12) United States Patent
Ito

(10) Patent No.: US 8,633,794 B2
(45) Date of Patent: Jan. 21, 2014

(54) ELECTRONIC COMPONENT AND MANUFACTURING METHOD FOR SAME

(71) Applicant: Murata Manufacturing Co., Ltd., Kyoto (JP)

(72) Inventor: Yoichiro Ito, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 13/631,107

(22) Filed: Sep. 28, 2012

(65) Prior Publication Data

US 2013/0027171 A1 Jan. 31, 2013

Related U.S. Application Data

(63) Continuation of application No. PCT/JP2010/068280, filed on Oct. 18, 2010.

(30) Foreign Application Priority Data

Mar. 31, 2010 (JP) ..... 2010-082720

(51) Int. Cl.
*H01F 27/24* (2006.01)
*H01F 5/00* (2006.01)

(52) U.S. Cl.
USPC ..... 336/234; 336/200; 336/233

(58) Field of Classification Search
USPC ..... 336/200, 223, 232, 233, 234; 156/182
See application file for complete search history.

(56) References Cited

U.S. PATENT DOCUMENTS

| | | | | |
|---|---|---|---|---|
| 6,060,976 | A * | 5/2000 | Yamaguchi et al. | 336/200 |
| 2008/0012679 | A1 * | 1/2008 | Okabe et al. | 336/200 |
| 2010/0033286 | A1 * | 2/2010 | Katayama et al. | 336/200 |
| 2010/0085140 | A1 * | 4/2010 | Tanaka et al. | 336/221 |

FOREIGN PATENT DOCUMENTS

| | | | |
|---|---|---|---|
| JP | 56-155516 | A | 12/1984 |
| JP | 2000-030946 | A | 1/2000 |
| JP | 2000-216024 | A | 8/2000 |
| JP | 2001-068341 | A | 3/2001 |
| JP | 2002-175917 | A | 6/2002 |
| JP | 2002-175927 | A | 6/2002 |
| JP | 2003-092214 | A | 3/2003 |
| JP | 2005-259774 | A | 9/2005 |
| JP | 2008-130736 | A | 6/2008 |
| JP | 2009-044030 | A | 2/2009 |

OTHER PUBLICATIONS

International Search Report; PCT/JP2010/068280; Jan. 18, 2011.

* cited by examiner

*Primary Examiner* — Alexander Talpalatski
*Assistant Examiner* — Mangtin Lian
(74) *Attorney, Agent, or Firm* — Studebaker & Brackett PC

(57) ABSTRACT

An electronic component and manufacturing method for preparing an electronic component includes providing a first insulator layer having a first nickel content rate. A coil conductor and a second insulator layer having a first bismuth content rate and a second nickel content rate higher than the first nickel content rate are provided on the first insulator layer. The first insulator layer, the coil conductor, and the second insulator layer constitute a first unit layer. The first unit layer and an exterior insulator layer are laminated to obtain a laminate. After a step of firing the laminate, a nickel content rate in a first portion of the first insulator layer, the first portion being sandwiched between the coil conductors from both sides facing in a lamination direction, is lower than a nickel content rate in a second portion of the first insulator layer other than the first portion.

3 Claims, 9 Drawing Sheets

ELECTRONIC COMPONENT AND MANUFACTURING METHOD FOR SAME

CROSS REFERENCE TO RELATED APPLICATIONS

The present application claims priority to International Application No. PCT/JP2010/068280 filed on Oct. 18, 2010, and to Japanese Patent Application No. 2010-082720 filed on Mar. 31, 2010, the entire contents of each of these applications being incorporated herein by reference in their entirety.

TECHNICAL FIELD

The technical field relates to an electronic component and a manufacturing method for the electronic component, and more particularly to an electronic component with a coil incorporated therein, and a manufacturing method for the electronic component.

BACKGROUND

As a conventional electronic component, there is known a multilayer coil component of open magnetic path type, which is described in Japanese Unexamined Patent Application Publication No. 2005-259774 (Patent Literature 1). FIG. 9 is a sectional structural view of a multilayer coil component 500 of open magnetic path type, which is described in Patent Literature 1.

The multilayer coil component 500 of open magnetic path type includes, as illustrated in FIG. 9, a laminate 502 and a coil L. The laminate 502 is made up of a plurality of magnetic layers laminated one above another. The coil L has a helical shape and is made up of a plurality of coil conductors 506 connected in series. Further, the multilayer coil component 500 of open magnetic path type includes a non-magnetic layer 504. The non-magnetic layer 504 is disposed in the laminate 502, and it extends across the coil L.

In the multilayer coil component 500 of open magnetic path type, a magnetic flux ϕ 510 circling around the coil L passes through the non-magnetic layer 504. This suppresses the occurrence of magnetic saturation due to excessive concentration of the magnetic flux within the laminate 502. As a result, the multilayer coil component 500 of open magnetic path type exhibits good direct-current superposition characteristics.

SUMMARY

The present disclosure provides an electronic component capable of suppressing the occurrence of magnetic saturation due to magnetic fluxes circling around individual coil conductors, and a manufacturing method for the electronic component.

In one aspect of the disclosure, a manufacturing method for an electronic component includes a step of forming a laminate that incorporates a helical coil made up of a plurality of coil conductors, and a step of firing the laminate. The step of forming the laminate includes a step of forming a first unit layer through a process of preparing a first insulator layer having a first Ni content rate, a process of forming the coil conductor, which constitutes the helical coil, on the first insulator layer, and a process of forming a second insulator layer on a portion of the first insulator layer other than the coil conductor, the second insulator layer having a first Bi content rate and a second Ni content rate higher than the first Ni content rate, and a step of laminating the first unit layer in plural.

In a more specific embodiment, the step of forming the laminate may further include a step of forming a second unit layer through a process of preparing another first insulator layer having the first Ni content rate, a process of forming another coil conductor, which constitutes the helical coil, on the first insulator layer, and a process of forming a third insulator layer on a portion of the another first insulator layer other than the coil conductor, the third insulator layer having a second Bi content rate lower than the first Bi content rate and a third Ni content rate higher than the first Ni content rate, and a step of laminating the first unit layer and the second unit layer.

In another more specific embodiment, the step of forming the laminate may further include a step of forming a third unit layer through a process of preparing another first insulator layer having the first Ni content rate, a process of forming another coil conductor, which constitutes the helical coil, on the another first insulator layer, and a process of forming another second insulator layer and a third insulator layer on portions of the first insulator layer other than the coil conductor, the third insulator layer having a second Bi content rate lower than the first Bi content rate and a third Ni content rate higher than the first Ni content rate, and a step of laminating the first unit layer and the third unit layer.

In yet another more specific embodiment, a thickness of each first insulator layer may be smaller than a thickness of each of the second insulator layer and the third insulator layer.

In still another more specific embodiment, the thickness of the first insulator layer may be in the range of 5 μm to 35 μm.

In another more specific embodiment, the first insulator layer may be a non-magnetic layer having a Ni content rate of zero.

In another more specific embodiment, given that a portion of the first insulator layer, the portion being sandwiched between the coil conductors from both sides in a lamination direction, is a first portion, and a portion of the first insulator layer, the portion being sandwiched between the second insulator layers from both sides in the lamination direction, is a second portion, after the step of firing the laminate, a Ni content rate in the first portion may be lower than a Ni content rate in the second portion, and the Ni content rate in the second portion ay be lower than the Ni content rate in the second insulator layer.

In still another more specific embodiment, given that a portion of the first insulator layer, the portion being sandwiched between the third insulator layers from both sides in a lamination direction, is a third portion, after the step of firing the laminate, a Ni content rate in the third portion may be lower than the Ni content rate in the second portion and may be lower than the Ni content rate in the third insulator layer.

In another aspect of the disclosure, an electronic component includes a first unit layer having a first insulator layer in form of a sheet, a coil conductor formed on the first insulator layer, and a second insulator layer formed on a portion of the first insulator layer other than the coil conductor. A helical coil is constituted with the first unit layer laminated in plural and with the coil conductor connected in plural to each other, and wherein, given that a portion of the first insulator layer, the portion being sandwiched between the coil conductors from both sides in a lamination direction, is a first portion, and a portion of the first insulator layer, the portion being sandwiched between the second insulator layers from both sides in the lamination direction, is a second portion, a Ni content rate in the first portion is lower than a Ni content rate in the second portion, and the Ni content rate in the second portion is lower than a Ni content rate in the second insulator layer.

In a more specific embodiment, the electronic component may further include a second unit layer having a first insulator layer in form of a sheet, a coil conductor formed on the first insulator layer, and a third insulator layer formed on a portion of the first insulator layer other than the coil conductor. A helical coil may be constituted with the first unit layer and the second unit layer laminated and with the coil conductor connected in plural to each other, and wherein, given that a portion of the first insulator layer, the portion being sandwiched between the third insulator layers from both sides in the lamination direction, is a third portion, a Ni content rate in the third portion may be lower than the Ni content rate in the second portion and may be lower than a Ni content rate in the third insulator layer.

In another more specific embodiment, the electronic component may further includes a third unit layer having a first insulator layer in form of a sheet, a coil conductor formed on the first insulator layer, and the second insulator layer and a third insulator layer which are formed on portions of the first insulator layer other than the coil conductor. A helical coil may be constituted with the first unit layer and the third unit layer laminated and with the coil conductor connected in plural to each other, and wherein, given that a portion of the first insulator layer, the portion being sandwiched between the third insulator layers from both sides in the lamination direction, is a third portion, a Ni content rate in the third portion may be lower than the Ni content rate in the second portion and may be lower than a Ni content rate in the third insulator layer.

DETAILED DESCRIPTION

Figure 9:
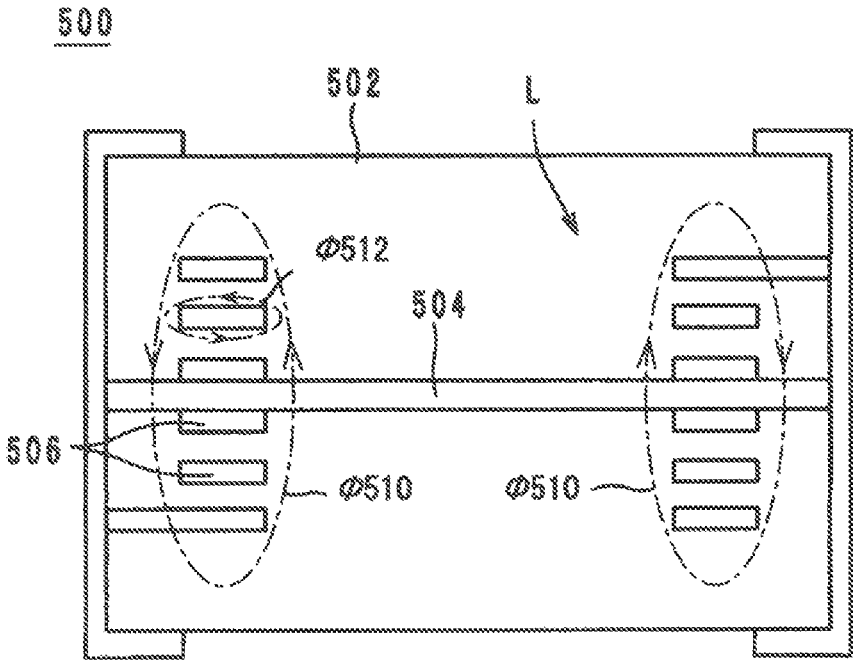
FIG. 9 PRIOR ART
FIG. 9 is a sectional structural view of a multilayer coil component of open magnetic path type, which is described in Patent Literature 1.

The inventor realized that in the multilayer coil component 500 of open magnetic path type shown in FIG. 9, a magnetic flux ϕ 512 circles around each of the coil conductors 506 further exists in addition to the magnetic flux ϕ 510 circling around the coil L. The magnetic flux ϕ 512 serves also as a factor causing the magnetic saturation in the multilayer coil component 500 of open magnetic path type.

Embodiments of electronic components and manufacturing methods for the electronic components according to the present disclosure can address the above shortcomings related to magnetic saturation.

Figure 1:
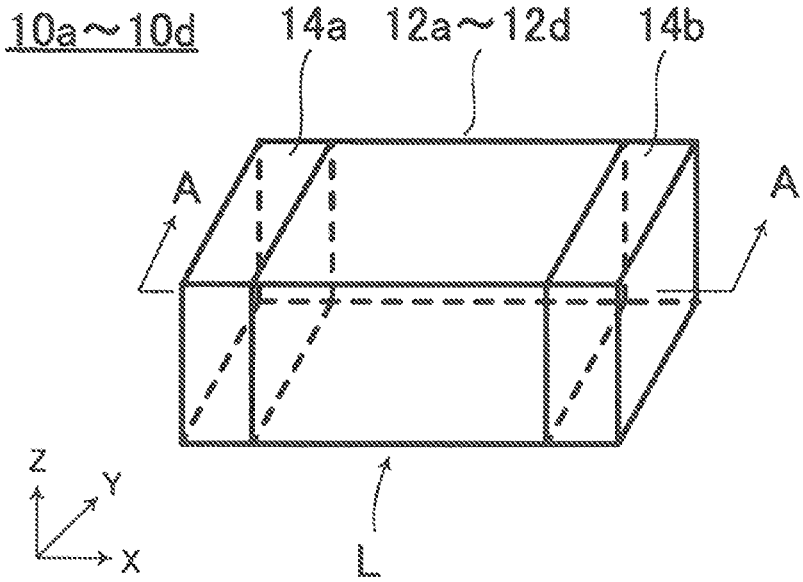
FIG. 1 is a perspective view illustrating an external appearance of each of electronic components according to exemplary embodiments.
Figure 2:
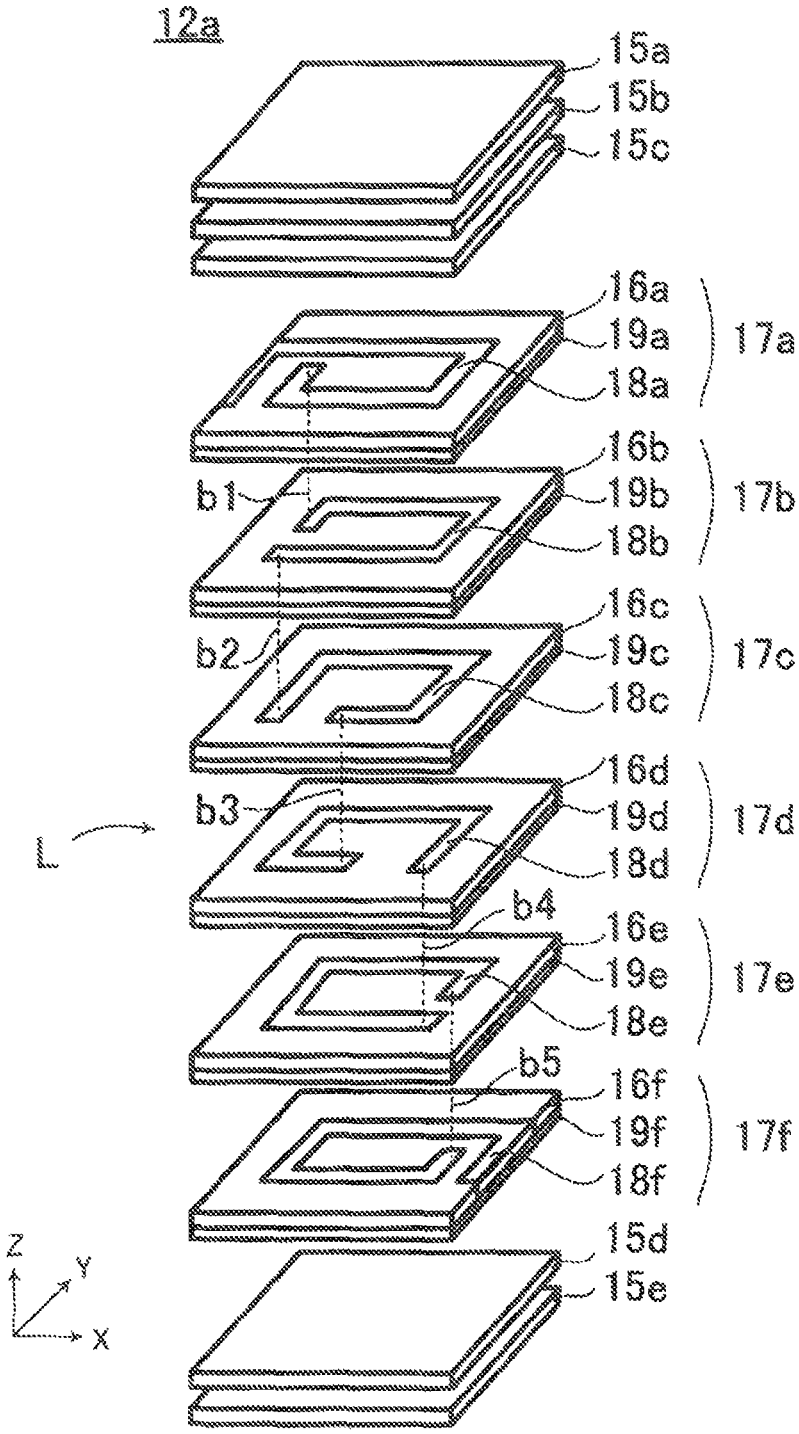
FIG. 2 is an exploded perspective view of a laminate of the electronic component according to one exemplary embodiment.
Figure 3:
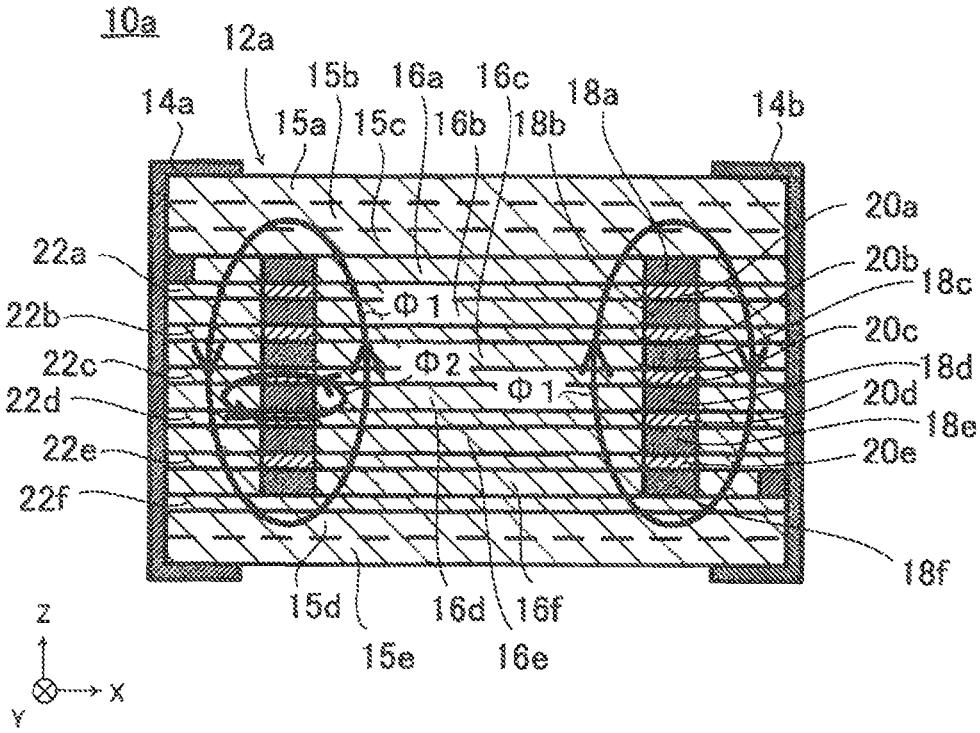
FIG. 3 is a sectional structural view of the electronic component taken along a line A-A in FIG. 1.

Electronic components according to exemplary embodiments will now be described with reference to the drawings. FIG. 1 is a perspective view illustrating an external appearance of each of electronic components 10*a* to 10*d* according to the exemplary embodiments. FIG. 2 is an exploded perspective view of a laminate 12*a* of the electronic component 10*a* according to one embodiment. FIG. 3 is a sectional structural view of the electronic component 10*a* taken along a line A-A in FIG. 1. More specifically, FIG. 2 illustrates the laminate 12*a* before firing. On the other hand, FIG. 3 illustrates the electronic component 10*a* after the firing. In the following description, a lamination direction of the electronic component 10*a* is defined as a z-axis direction, a direction along a long side of the electronic component 10*a* is defined as an x-axis direction, and a direction along a short side of the electronic component 10*a* is defined as a y-axis direction. An x-axis, a y-axis, and a z-axis are orthogonal to one another.

The electronic component 10*a* includes, as illustrated in FIG. 1, the laminate 12*a* and outer electrodes 14*a* and 14*b*. The laminate 12*a* has a rectangular parallelepiped shape and incorporates a coil L.

The outer electrodes 14*a* and 14*b* are each electrically connected to the coil L and are provided on lateral surfaces of the laminate 12*a*, which are opposed to each other. In this embodiment, the outer electrodes 14*a* and 14*b* are disposed so as to cover respective lateral surfaces, which are positioned at respective ends of the laminate 12*a* in the x-axis direction.

As illustrated in FIG. 2, the laminate 12*a* is made up of exterior insulator layers 15*a* to 15*e*, the first insulator layers 19*a* to 19*f*, second insulator layers 16*a* to 16*f*, coil conductors 18*a* to 18*f*, and via hole conductors b1 to b5.

The exterior insulator layers 15*a* to 15*e* are each an insulator layer, which has a rectangular shape and which has a first bismuth (Bi) content rate and a second nickel (Ni) content rate higher than a first Ni content rate, similarly to the second insulator layers 16*a* to 16*f* described later. In other words, each exterior insulator layer is a magnetic layer in the form of one sheet made of Ni—Cu—Zn based ferrite containing Bi. The exterior insulator layers 15*c*, 15*b* and 15*a* are laminated in the order named, as illustrated, on the more positive side in the z-axis direction than a region where the coil conductors 18*a* to 18*f* are disposed, and they constitute an outer layer. Further, the exterior insulator layers 15*d* and 15*e* are laminated in the order named, as illustrated, on the more negative side in the z-axis direction than the region where the coil conductors 18*a* to 18*f* are disposed, and they constitute another outer layer.

The first insulator layers 19*a* to 19*f* are each an insulator layer, which has a rectangular shape as illustrated in FIG. 2, and which has the first Ni content rate. In this embodiment, the first insulator layers 19*a* to 19*f* are each a non-magnetic layer made of Cu—Zn based ferrite having the Ni content rate of zero. It is to be noted that the first insulator layers 19*a* to 19*f* are non-magnetic layers before the firing, but they partially become magnetic layers after the firing as described later.

Each of the coil conductors 18*a* to 18*f* is made of a conductive material, i.e., Ag, and has a length of ⅞ turn as illustrated in FIG. 2. The coil conductors 18*a* to 18*f* constitute the coil L in cooperation with the via hole conductors b1 to b5. The coil conductors 18*a* to 18*f* are provided on the first insulator layers 19*a* to 19*f*, respectively. Further, one end of the coil conductor 18*a* is led out on the first insulator layer 19*a* to its short side on the negative side in the x-axis direction, thereby constituting a lead conductor. The one end of the coil conductor 18*a* is connected to the outer electrode 14*a* in FIG.

1. One end of the coil conductor 18*f* is led out on the first insulator layer 19*f* to its short side on the positive side in the x-axis direction, thereby constituting a lead conductor. The one end of the coil conductor 18*f* is connected to the outer electrode 14*b* in FIG. 1. Moreover, the coil conductors 18*a* to 18*f* overlap with one another and form one rectangular ring in a plan view looking from the z-axis direction.

As illustrated in FIG. 2, the via hole conductors b1 to b5 penetrate through the first insulator layers 19*a* to 19*e* in the z-axis direction, respectively, thereby connecting adjacent two conductors among the coil conductors 18*a* to 18*f* in the z-axis direction. In more detail, the via hole conductor b1 connects the other end of the coil conductor 18*a* and one end of the coil conductor 18*b*. The via hole conductor b2 connects the other end of the coil conductor 18*b* and one end of the coil conductor 18*c*. The via hole conductor b3 connects the other end of the coil conductor 18*c* and one end of the coil conductor 18*d*. The via hole conductor b4 connects the other end of the coil conductor 18*d* and one end of the coil conductor 18*e*. The via hole conductor b5 connects the other end of the coil conductor 18*e* and the other end of the coil conductor 18*f* (as mentioned above, the one end of the coil conductor 18*f* constitutes the lead conductor). Thus, the coil conductors 18*a* to 18*f* and the via hole conductors b1 to b5 constitute the helical coil L having a coil axis that extends in the z-axis direction.

As illustrated in FIG. 2, the second insulator layers 16*a* to 16*f* are disposed on portions of the first insulator layers 19*a* to 19*f* other than the coil conductors 18*a* to 18*f*, respectively. Accordingly, respective principal surfaces of the first insulator layers 19*a* to 19*f* are covered with the second insulator layers 16*a* to 16*f* and the coil conductors 18*a* to 18*f*. Further, a principal surface of each of the second insulator layers 16*a* to 16*f* and a principal surface of corresponding one of the coil conductors 18*a* to 18*f* constitute substantial one plane, and those principal surfaces are flush with each other. Moreover, the second insulator layers 16*a* to 16*f* are each an insulator layer having the first Bi content rate and the second Ni content rate higher than the first Ni content rate. Stated another way, in this embodiment, the second insulator layers 16*a* to 16*f* are each a magnetic layer made of Ni—Cu—Zn based ferrite containing Bi.

Here, each of the first insulator layers 19*a* to 19*f* has a smaller thickness than each of the second insulator layers 16*a* to 16*f*. More specifically, each of the first insulator layers 19*a* to 19*f* is 5 μm or more and 35 μm or less in thickness.

The first insulator layers 19*a* to 19*f*, the second insulator layers 16*a* to 16*f*, and the coil conductors 18*a* to 18*f* constitute first unit layers 17*a* to 17*f*, respectively. The first unit layers 17*a* to 17*f* are successively laminated in the order named, as illustrated, between the exterior insulator layers 15*a* to 15*c* and the exterior insulator layers 15*d* and 15*e*. In this way, the laminate 12*a* is constructed.

The laminate 12*a* thus obtained is fired and the outer electrodes 14*a* and 14*b* are then formed thereon, whereby the electronic component 10*a* has a sectional structure illustrated in FIG. 3. More specifically, during the firing of the laminate 12*a*, the Ni content rate in a part of each of the first insulator layers 19*a* to 19*f* is increased to be higher than the first Ni content rate. Stated another way, parts of the first insulator layers 19*a* to 19*f* are each changed from a non-magnetic layer to a magnetic layer.

In more detail, as illustrated in FIG. 3, the first insulator layers 19*a* to 19*f* in the electronic component 10*a* include first portions 20*a* to 20*e* and second portions 22*a* to 22*f*. The first portions 20*a* to 20*e* are portions of the first insulator layers 19*a* to 19*e*, which are each sandwiched between adjacent two conductors among the coil conductors 18*a* to 18*f* from both sides facing in the z-axis direction. More specifically, the first portion 20*a* is a portion of the first insulator layer 19*a* sandwiched between the coil conductor 18*a* and the coil conductors 18*b*. The first portion 20*b* is a portion of the first insulator layer 19*b* sandwiched between the coil conductor 18*b* and the coil conductors 18*c*. The first portion 20*c* is a portion of the first insulator layer 19*c* sandwiched between the coil conductor 18*c* and the coil conductors 18*d*. The first portion 20*d* is a portion of the first insulator layer 19*d* sandwiched between the coil conductor 18*d* and the coil conductors 18*e*. The first portion 20*e* is a portion of the first insulator layer 19*e* sandwiched between the coil conductor 18*e* and the coil conductors 18*f*.

The second portions 22*a* to 22*f* are portions of the first insulator layers 19*a* to 19*f* other than the first portions 20*a* to 20*e*. However, in the first insulator layer 19*f*, the first portion 20*a* is not present and only the second portion 22*f* is present. The reason is that the first insulator layer 19*f* is positioned on the more negative side in the z-axis direction than the coil conductor 18*f*, which is positioned farthest on the negative side in the z-axis direction.

The Ni content rate in each of the first portions 20*a* to 20*e* is lower than that in each of the second portions 22*a* to 22*f*. In this embodiment, the first portions 20*a* to 20*e* do not contain Ni. Thus, the first portions 20*a* to 20*e* are non-magnetic layers. On the other hand, the second portions 22*a* to 22*f* contain Ni. Thus, the second portions 22*a* to 22*f* are magnetic layers. Furthermore, the Ni content rate in each of the second portions 22*a* to 22*f* is lower than that in each of the second insulator layers 16*a* to 16*f*.

An exemplary manufacturing method for the electronic component 10*a* will now be described with reference to the drawings. The manufacturing method for the electronic component 10*a* is carried out when simultaneously producing the electronic components 10*a*.

First, ceramic green sheets to be the first insulator layers 19*a* to 19*f*, illustrated in FIG. 2, are prepared. More specifically, ferric oxide ($Fe_2O_3$), zinc oxide (ZnO), and copper oxide (CuO) in respective amounts weighed at a predetermined ratio are put, as raw materials, in a ball mill and are subjected to wet mixing. The obtained mixture is dried and ground. The obtained powder is calcined at 800° C. for 1 hour. The calcined powder is subjected to wet grinding in a ball mill and is disintegrated after drying, whereby ferrite ceramic powder is obtained.

A water based binder (e.g., vinylacetate or water-soluble acryl), an organic binder (e.g., polyvinyl butyral), a dispersant, and a defoaming agent are added to the ferrite ceramic powder, and the resulting mixture is mixed in a ball mill. Ceramic slurry is then obtained through steps of depressurization and defoaming. The obtained ceramic slurry is coated in the form of a sheet over a carrier sheet by the doctor blade method and is dried. The ceramic green sheets to be the first insulator layers 19*a* to 19*f* are thereby fabricated.

Next, ceramic green sheets to be the exterior insulator layers 15*a* to 15*e*, illustrated in FIG. 2, are prepared. More specifically, ferric oxide ($Fe_2O_3$), zinc oxide (ZnO), nickel oxide (NiO), copper oxide (CuO), and bismuth oxide ($Bi_2O_3$) in respective amounts weighed at a predetermined ratio are put, as raw materials, in a ball mill and are subjected to wet mixing. The obtained mixture is dried and ground. The obtained powder is calcined at 800° C. for 1 hour. The calcined powder is subjected to wet grinding in a ball mill and is disintegrated after drying, whereby ferrite ceramic powder is obtained.

A water based binder (e.g., vinylacetate or water-soluble acryl), an organic binder (e.g., polyvinyl butyral), a dispersant, and a defoaming agent are added to the ferrite ceramic powder, and the resulting mixture is mixed in a ball mill. Ceramic slurry is then obtained through steps of depressurization and defoaming. A proportion of the bismuth oxide in the ceramic slurry is adjusted to 1.5% by weight in terms of a raw-material ratio. The obtained ceramic slurry is coated in the form of a sheet over a carrier sheet by the doctor blade method and is dried. The ceramic green sheets to be the exterior insulator layers 15*a* to 15*e* are thereby fabricated.

Next, a ceramic paste for ceramic paste layers to be the second insulator layers 16*a* to 16*f*, illustrated in FIG. 2, is prepared. More specifically, ferric oxide ($Fe_2O_3$), zinc oxide (ZnO), nickel oxide (NiO), copper oxide (CuO), and bismuth oxide ($Bi_2O_3$) in respective amounts weighed at a predetermined ratio are put, as raw materials, in a ball mill and are subjected to wet mixing. The obtained mixture is dried and ground. The obtained powder is calcined at 800° C. for 1 hour. The calcined powder is subjected to wet grinding in a ball mill and is disintegrated after drying, whereby ferrite ceramic powder is obtained.

A mixture of a binder (e.g., ethyl cellulose, PVB, methyl cellulose, or acryl resin), terpineol, a dispersant, and a plasticizer is added to the ferrite ceramic powder and kneaded, whereby the ceramic paste for the ceramic paste layers to be the second insulator layers 16*a* to 16*f* is obtained. Here, a proportion of the bismuth oxide in the ceramic paste is adjusted to 1.5% by weight in terms of a raw-material ratio.

Next, as illustrated in FIG. 2, the via hole conductors b1 to b5 are formed in the respective ceramic green sheets to be the first insulator layers 19*a* to 19*e*. More specifically, via holes are formed by emitting a laser beam to the ceramic green sheets to be the first insulator layers 19*a* to 19*e*. The formed via holes are then filled with a conductive paste made of, e.g., Ag, Pd, Cu or Au, by print coating, for example. The conductive paste may be made of Ag alloy, Pd alloy, Cu alloy or Au alloy.

Next, as illustrated in FIG. 2, the coil conductors 18*a* to 18*f* are formed on the respective ceramic green sheets to be the first insulator layers 19*a* to 19*f*. More specifically, the coil conductors 18*a* to 18*f* are formed by coating a conductive paste, which is primarily made of, e.g., Ag, Pd, Cu, Au or an alloy thereof, over the ceramic green sheets to be the first insulator layers 19*a* to 19*f* by screen printing, for example. It is to be noted that a step of forming the coil conductors 18*a* to 18*f* and a step of filling the conductive paste in the via holes may be performed in the same step.

Next, as illustrated in FIG. 2, the ceramic paste layers to be the second insulator layers 16*a* to 16*f* are formed on portions of the respective ceramic green sheets, which are to be the first insulator layers 19*a* to 19*f*, other than the coil conductors 18*a* to 18*f*. More specifically, the ceramic paste layers to be the second insulator layers 16*a* to 16*f* are formed by coating the ceramic paste with screen printing or some other suitable method. Ceramic green layers to be the first unit layers 17*a* to 17*f*, illustrated in FIG. 2, are formed through the above-described steps.

Next, as illustrated in FIG. 2, the ceramic green sheets to be the exterior insulator layers 15*a* to 15*c*, the ceramic green layers to be the first unit layers 17*a* to 17*f*, and the ceramic green sheets to be the exterior insulator layers 15*d* and 15*e* are successively laminated in the order named and press-bonded, whereby an unfired mother laminate is obtained. A process of laminating and press-bonding the ceramic green sheets to be the exterior insulator layers 15*a* to 15*c*, the ceramic green layers to be the first unit layers 17*a* to 17*f*, and the ceramic green sheets to be the exterior insulator layers 15*d* and 15*e* is performed by laminating them one by one, tentatively press-bonding the laminated layers, and then subjecting the unfired mother laminate to main press-bonding under pressure with an isostatic press, for example.

In the lamination step, the ceramic green layers to be the first unit layers 17*a* to 17*f* are successively laminated in the z-axis direction, whereby the coil L is formed. Thus, in the unfired mother laminate, as illustrated in FIG. 2, the coil conductors 18*a* to 18*f* and the first insulator layers 19*a* to 19*f* are alternately arranged in the z-axis direction.

Next, the mother laminate is cut into the laminate 12*a* having a predetermined size by a cutting blade. As a result, the laminate 12*a*, which is unfired, is obtained. The unfired laminate 12*a* is then subjected to debinding and firing. The debinding is performed in a low oxygen atmosphere on conditions of, e.g., 500° C. for 2 hours. The firing is performed on conditions of, e.g., 870° C. to 900° C. for 2.5 hours.

During the firing, there occurs diffusion of Ni into the first insulator layers 19*a* to 19*f* from the second insulator layers 16*a* to 16*f* and the exterior insulator layer 15*d*. In more detail, as illustrated in FIG. 3, because the second portions 22*a* to 22*f* of the first insulator layers 19*a* to 19*f* are contacted with the second insulator layers 16*a* to 16*f* and the exterior insulator layer 15*d*, and each of those layers containing Ni, Ni is diffused into the second portions 22*a* to 22*f* from the second insulator layers 16*a* to 16*f* and the exterior insulator layer 15*d*. Therefore, the second portions 22*a* to 22*f* become magnetic layers. However, the Ni content rate in each of the second portions 22*a* to 22*f* is lower than the second Ni content rate in each of the second insulator layers 16*a* to 16*f* and the exterior insulator layer 15*d*.

Here, Bi contained in the second insulator layers 16*a* to 16*f* and the exterior insulator layer 15*d* has a very important role in relation to the diffusion of Ni.

When Ni contained the second insulator layers 16*a* to 16*f* and the exterior insulator layer 15*d* is diffused into the first insulator layers 19*a* to 19*f*, the diffusion of Ni is promoted as those layers contain Bi in larger amount. In other words, Bi contained in the second insulator layers 16*a* to 16*f* and the exterior insulator layer 15*d* serves to promote the diffusion of Ni. From point of view described above, in the present embodiment, Bi is contained in the second insulator layers 16*a* to 16*f* and the exterior insulator layer 15*d*.

On the other hand, because the first portions 20*a* to 20*e* of the first insulator layers 19*a* to 19*e* are not contacted with the second insulator layers 16*a* to 16*f* and the exterior insulator layer 15*d* (i.e., the first portions 20*a* to 20*e* do not overlap the second insulator layers 16*a* to 16*f* as viewed from the coil axis or lamination direction), Ni is not diffused into the first portions 20*a* to 20*e* from the second insulator layers 16*a* to 16*f* and the exterior insulator layer 15*d*. Therefore, the first portions 20*a* to 20*e* remain as non-magnetic layers not containing Ni. It is to be noted that, while the first portions 20*a* to 20*e* substantially do not contain Ni, they may contain Ni diffused through the second portions 22*a* to 22*e*. Accordingly, the first portions 20*a* to 20*e* may contain Ni, but in such a small amount as not exhibiting magnetism. Even in that case, the Ni content rate in each of the first portions 20*a* to 20*e* is lower than that in each of the second portions 22*a* to 22*f*.

The laminate 12*a* having been fired is obtained through the above-described steps. The laminate 12*a* is chamfered by barrel polishing. Silver electrodes to be the outer electrodes 14*a* and 14*b* are then formed by coating an electrode paste, which is primarily made of silver, over the surface of the laminate 12*a* with an immersion process or some other suitable method, and by firing the coated electrode paste. The silver electrodes are fired at 800° for 60 minutes.

Finally, the outer electrodes 14*a* and 14*b* are formed by plating Ni/Sn on the surfaces of the silver electrodes. The electronic component 10*a*, illustrated in FIG. 1, is completed through the above-described steps.

According to the electronic component 10*a* and the manufacturing method for the same, the occurrence of magnetic saturation due to a magnetic flux circling around each of the coil conductors 18*a* to 18*f* can be suppressed as described below. In more detail, while a current flows through the coil L of the electronic component 10*a*, there is generated, as illustrated in FIG. 3, not only a magnetic flux ϕ1 that has a relatively long magnetic path circling around the entirety of the coil conductors 18*a* to 18*f*, but also a magnetic flux ϕ2 that has a relatively short magnetic path circling around each of the coil conductors 18*a* to 18*f* (FIG. 3 illustrates only the magnetic flux ϕ2 generated around the coil conductor 18*d*). As with the magnetic flux ϕ1, the magnetic flux ϕ2 may also become a factor causing the magnetic saturation in the electronic component 10*a*.

To cope with such a problem, in the electronic component 10*a* fabricated by the manufacturing method described above, the first portions 20*a* to 20*e* of the first insulator layers 19*a* to 19*f*, each sandwiched between adjacent two conductors among the coil conductors 18*a* to 18*f* from both sides facing in the z-axis direction, are provided as non-magnetic layers. Therefore, the magnetic flux ϕ2 circling around each of the coil conductors 18*a* to 18*f* passes through corresponding one of the first portions 20*a* to 20*e* that are non-magnetic layers. Hence, a magnetic flux density of the magnetic flux ϕ2 is prevented from being excessively increased, and the occurrence of the magnetic saturation in the electronic component 10*a* is suppressed. As a result, a direct current superposition characteristic of the electronic component 10*a* is improved.

For more positively confirming the advantageous effect of the electronic component 10*a* and the manufacturing method for the same, the inventor of this application has conducted a computer simulation as described below. More specifically, the inventor has fabricated a first model corresponding to the electronic component 10*a*, and a second model in which the first insulator layers 19*a* to 19*f* of the electronic component 10*a* are formed as magnetic layers. Simulation conditions are as follows:

Number of turns of the coil L: 8.5 turns

Size of the electronic component: 2.5 mm×2.0 mm×1.0 mm

Thickness of each of the first insulator layers 19*a* to 19*f*: 10 μm

Figure 4:
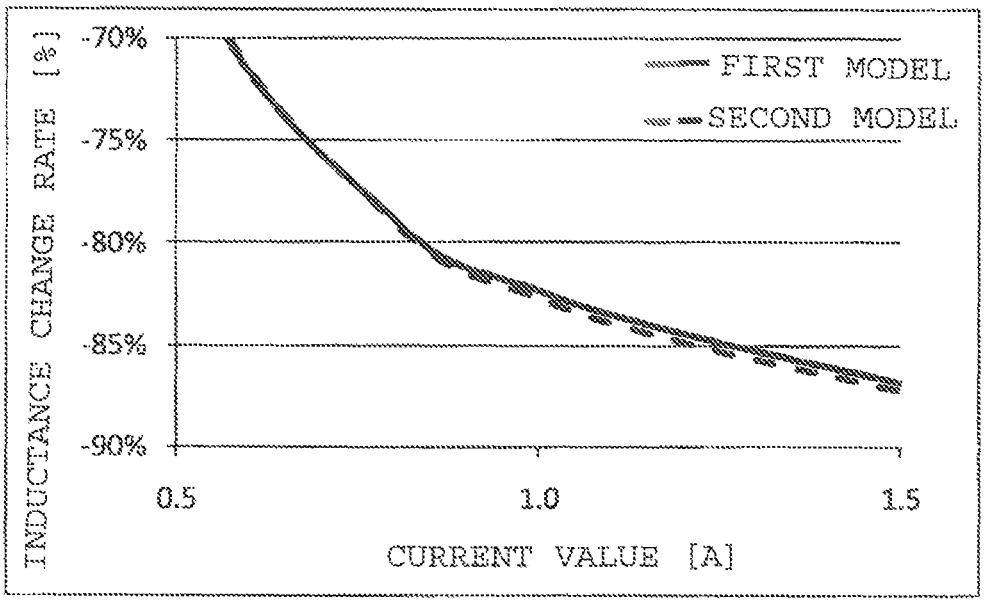
FIG. 4 is a graph plotting simulation results in a first model and a second model.

FIG. 4 is a graph depicting the simulation results. The horizontal axis of the graph represents a value of the current applied to each model. The vertical axis of the graph represents an inductance change rate on the basis of an inductance value when the current value is substantially zero (e.g., 0.001 A).

As seen from FIG. 4, an inductance change rate in the first model is smaller than that in the second model even when the current value is increased. It is hence understood that the first model is superior in a direct current superposition characteristic to the second model. This implies that, due to the magnetic flux circling around each coil conductor, the magnetic saturation is more apt to generate in the second model than in the first model. As a result, it is understood that the occurrence of the magnetic saturation due to the magnetic flux ϕ2 circling around each of the coil conductors 18*a* to 18*f* can be suppressed in the electronic component 10*a* and with the manufacturing method for the same.

Further, according to the electronic component 10*a* and the manufacturing method for the same, the first portions 20*a* to 20*e* serving as non-magnetic layers can be formed with high accuracy. In more detail, as a method of forming a non-magnetic layer in a portion sandwiched between coil conductors in a typical electronic component, it is conceivable, for example, to print a non-magnetic paste over the portion sandwiched between the coil conductors.

With the method of printing the non-magnetic paste, however, there is a possibility that the non-magnetic layer may protrude from the portion sandwiched between the coil conductors due to a printing misalignment and a lamination misalignment. If the non-magnetic layer protrudes from the portion sandwiched between the coil conductors, the protruded non-magnetic layer may impede the magnetic flux circling around the entirety of the coil conductors and having the long magnetic path. Stated another way, not only the intended magnetic flux, but also the other magnetic flux can pass through the non-magnetic layer.

In contrast, according to the electronic component 10*a* and the manufacturing method for the same, the first portions 20*a* to 20*e* serving as non-magnetic layers are formed during the firing after the laminate 12*a* has been fabricated. Therefore, the first portions 20*a* to 20*e* are each prevented from protruding from the portion sandwiched between adjacent two of the coil conductors 18*a* to 18*f* due to a printing misalignment and a lamination misalignment. Thus, according to the electronic component 10*a* and the manufacturing method for the same, the first portions 20*a* to 20*e* serving as non-magnetic layers can be formed with high accuracy. As a result, passage of the magnetic flux ϕ1 other than the intended magnetic flux ϕ2 through the non-magnetic layer is suppressed.

Moreover, in the electronic component 10*a*, the first unit layers 17*a* to 17*f* are successively laminated in the order named between the exterior insulator layers 15*a* to 15*c* and the exterior insulator layers 15*d* and 15*e*. With such an arrangement, the non-magnetic layers are positioned only in the first portions 20*a* to 20*e* each sandwiched between adjacent two of the coil conductors 18*a* to 18*f*. Thus, a non-magnetic layer extending across the coil L does not exist.

Still further, in the electronic component 10*a* and the manufacturing method for the same, the thickness of each of the first insulator layers 19*a* to 19*f* is preferably 5 μm or more and 35 μm or less.

If the thickness of each of the first insulator layers 19*a* to 19*f* is less than 5 μm, a difficulty would arise in fabricating the ceramic green sheets that are to be the first insulator layers 19*a* to 19*f*. On the other hand, if the thickness of each of the first insulator layers 19*a* to 19*f* is more than 35 μm, Ni would be not sufficiently diffused and a difficulty would arise in converting the second portions 22*a* to 22*f* to the magnetic layers.

In the electronic component 10*a*, a non-magnetic layer extending across the coil L does not exist. However, a non-magnetic layer may exist in a portion of the electronic component 10*a* other than the first portions 20*a* to 20*e*. The reason is that the presence of such a non-magnetic layer can be used to adjust the direct current superposition characteristic and the inductance value of the electronic component. Electronic components according to modifications, in which a non-magnetic layer is disposed in a portion other than the first portions 20*a* to 20*e*, will be described below.

Figure 5:
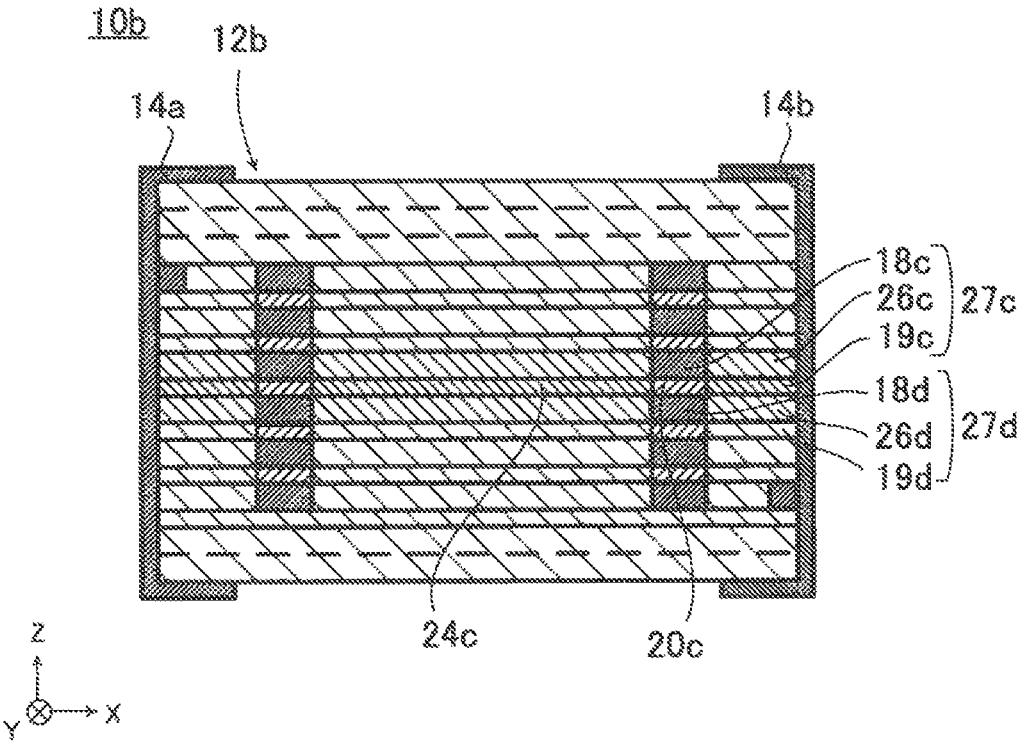
FIG. 5 is a sectional structural view of an electronic component according to a first exemplary modification.

An exemplary electronic component 10*b* and an exemplar manufacturing method for the same according to a first exemplary modification will now be described with reference to the drawings. FIG. 5 is a sectional structural view of the electronic component 10*b* according to the first exemplary modification. For the sake of simplicity of the drawing, some of reference symbols denoting the same components as those in FIG. 3 are not shown in FIG. 5.

The electronic component 10*b* differs from the electronic component 10*a* in that, in the electronic component 10*b*, third insulator layers 26*c* and 26*d*, each having a second Bi content rate lower than the first Bi content rate and a third Ni content rate higher than the first Ni content rate, are provided instead of the second insulator layers 16*c* and 16*d* as the magnetic layers.

Here, the third insulator layers 26*c* and 26*d* are formed on or provided on portions of the first insulator layers 19*c* and 19*d* other than the coil conductors 18*c* and 18*d*, respectively. Accordingly, principal surfaces of the first insulator layers 19*c* and 19*d* are covered with the third insulator layers 26*c* and 26*d* and the coil conductors 18*c* and 18*d*. Further, corresponding respective principal surfaces of the third insulator layers 26*c* and 26*d* and the coil conductors 18*c* and 18*d* individually constitute one plane, and they are flush with each other. Moreover, the thickness of each of the first insulator layers 19*c* and 19*d* is smaller than that of each of the third insulator layers 26*c* and 26*d*.

In the electronic component 10*b* according to the first exemplary modification, during the firing, Ni is diffused into the first insulator layer 19*c* from the third insulator layers 26*c* and 26*d*.

In more detail, as illustrated in FIG. 5, because a third portion 24*c* of the first insulator layer 19*c* (namely, a portion of the first insulator layer 19*c* other than the first portion 20*c*, i.e., other than the portion sandwiched between the coil conductor 18*c* and the coil conductor 18*d*) is contacted with the third insulator layers 26*c* and 26*d*, Ni is diffused into the third portion 24*c* from the third insulator layers 26*c* and 26*d*.

However, an amount of Ni diffused into the third portion 24*c* from the third insulator layers 26*c* and 26*d* is smaller than that diffused into the first insulator layers 19*a*, 19*b*, 19*d* and 19*e* from the second insulator layers 16*a*, 16*b*, 16*e* and 16*f* and the exterior insulator layer 15*d*.

As described above, the reason that a smaller amount of Ni diffuses into third portion 24*c* is that Bi has a very important role in the diffusion of Ni, and Bi contributes to promoting the diffusion of Ni. On the other hand, the Bi content rate in each of the third insulator layers 26*c* and 26*d* is lower than that in each of the second insulator layers 16*a*, 16*b*, 16*e* and 16*f*. Therefore, the amount of Ni diffused into the third portion 24*c* of the first insulator layer 19*c* is reduced.

Accordingly, the third portion 24*c* becomes a non-magnetic layer containing Ni in such a small amount as not exhibiting magnetism, or a non-magnetic layer containing Ni only in surface layer portions positioned very close to both surfaces thereof, which are contacted with the third insulator layers 26*c* and 26*d*.

Here, the Ni content rate in the third portion 24*c* is lower than that in each of the second portions 22*a*, 22*b*, 22*d* and 22*e*, and is also lower than that in each of the third insulator layers 26*c* and 26*d*.

Consequently, in the electronic component 10*b*, the third portion 24*c* serving as the non-magnetic layer is formed on or provided on both the inner and outer sides of the coil L. This allows the magnetic flux $\phi$1 to pass through the third portion 24*c* that is the non-magnetic layer. As a result, in the electronic component 10*b*, the occurrence of the magnetic saturation due to the magnetic flux $\phi$1 is suppressed.

As an exemplary manufacturing method for the electronic component 10*b*, a ceramic paste for ceramic paste layers to be the third insulator layers 26*c* and 26*d* are first prepared as follows.

More specifically, ferric oxide ($Fe_2O_3$), zinc oxide (ZnO), nickel oxide (NiO), copper oxide (CuO), and bismuth oxide ($Bi_2O_3$) in respective amounts weighed at a predetermined ratio are put, as raw materials, in a ball mill and are subjected to wet mixing. The obtained mixture is dried and ground. The obtained powder is calcined at 800° C. for 1 hour. The calcined powder is subjected to wet grinding in a ball mill and is disintegrated after drying, whereby ferrite ceramic powder is obtained.

A mixture of a binder (e.g., ethyl cellulose, PVB, methyl cellulose, or acryl resin), terpineol, a dispersant, and a plasticizer is added to the ferrite ceramic powder and kneaded, whereby the ceramic paste for the ceramic paste layers to be the third insulator layers 26*c* and 26*d* is obtained. Here, a proportion of the bismuth oxide in the ceramic paste is adjusted to 0.2% by weight in terms of a raw-material ratio.

Next, the via hole conductors b3 and b4 are formed in the respective ceramic green sheets to be the first insulator layers 19*c* and 19*d*. Since a method of forming the via hole conductors b3 and b4 has been described above, the description of the method is not repeated here.

Next, the coil conductors 18*c* and 18*d* are formed on the respective ceramic green sheets to be the first insulator layers 19*c* and 19*d*. Since a method of forming the coil conductors 18*c* and 18*d* has been described above, the description of the method is not repeated here.

Next, the ceramic paste layers to be the third insulator layers 26*c* and 26*d* are formed on portions of the respective ceramic green sheets, which are to be the first insulator layers 19*c* and 19*d*, other than the coil conductors 18*c* and 18*d*.

More specifically, the ceramic paste layers to be the third insulator layers 26*c* and 26*d* are formed by coating the ceramic paste with screen printing or some other suitable method.

Ceramic green layers to be second unit layers 27*c* and 27*d* are formed through the above-described steps.

Next, the ceramic green sheets to be the exterior insulator layers 15*a* to 15*c*, the ceramic green layers to be the first unit layers 17*a* to 17*b*, the second unit layers 27*c* and 27*d*, and the first unit layers 17*e* to 17*f*, and the ceramic green sheets to be the exterior insulator layers 15*d* and 15*e* are successively laminated in the order named and press-bonded, whereby an unfired mother laminate is obtained. The other steps in the method of manufacturing the electronic component 10*b* are similar to those in the method of manufacturing the electronic component 10*a*, and hence the description of the other steps is not repeated here.

For more positively confirming the advantageous effect of the electronic component 10*b* and the manufacturing method for the same, the inventor has conducted a computer simulation as described below. More specifically, the inventor has fabricated a third model corresponding to the electronic component 10*b*, and a fourth model in which the first insulator layers 19*a*, 19*b*, 19*d*, 19*e* and 19*f* of the electronic component 10*b* are formed as magnetic layers, whereas the first insulator layer 19*c* is formed as a non-magnetic layer. Simulation conditions are as follows:

Number of turns of the coil L: 8.5 turns

Size of the electronic component: 2.5 mm×2.0 mm×1.0 mm

Thickness of each of the first insulator layers 19*a* to 19*f*: 10 μm

Figure 6:
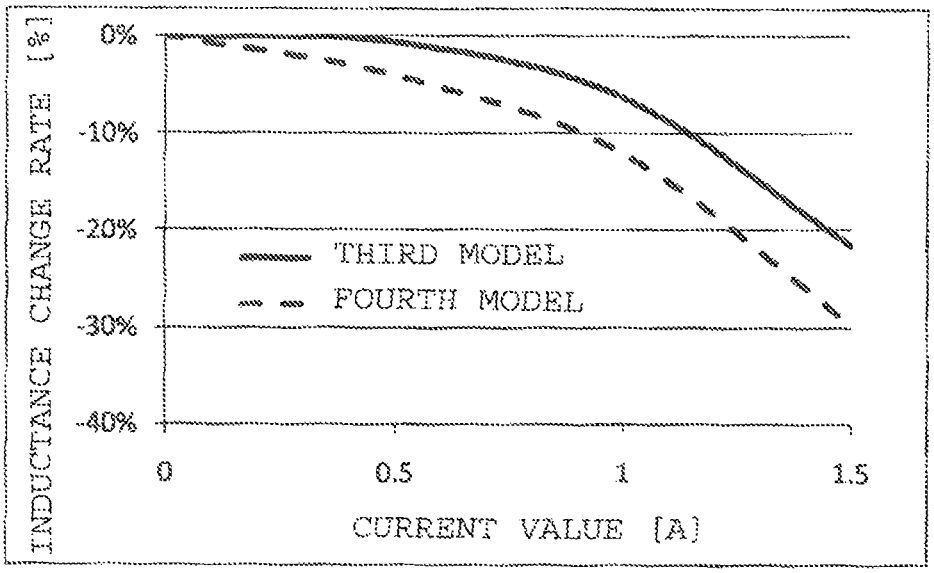
FIG. 6 is a graph plotting simulation results in a third model and a fourth model.

FIG. 6 is a graph depicting the simulation results. The horizontal axis of the graph represents a value of the current applied to each model. The vertical axis of the graph represents an inductance change rate on the basis of an inductance value when the current value is substantially zero (e.g., 0.01 A).

As seen from FIG. 6, an inductance change rate in the third model is smaller than that in the fourth model even when the current value is increased. It is hence understood that the third model is superior in a direct current superposition characteristic to the fourth model. This implies that, due to the magnetic flux circling around each coil conductor, the magnetic saturation is more apt to generate in the fourth model than in the third model. As a result, it is understood that the occurrence of the magnetic saturation due to the magnetic fluxes $\phi$1 and $\phi$2 circling around each of the coil conductors 18*a* to 18*f* can be suppressed in the electronic component 10*b* and with the manufacturing method for the same.

Figure 7:
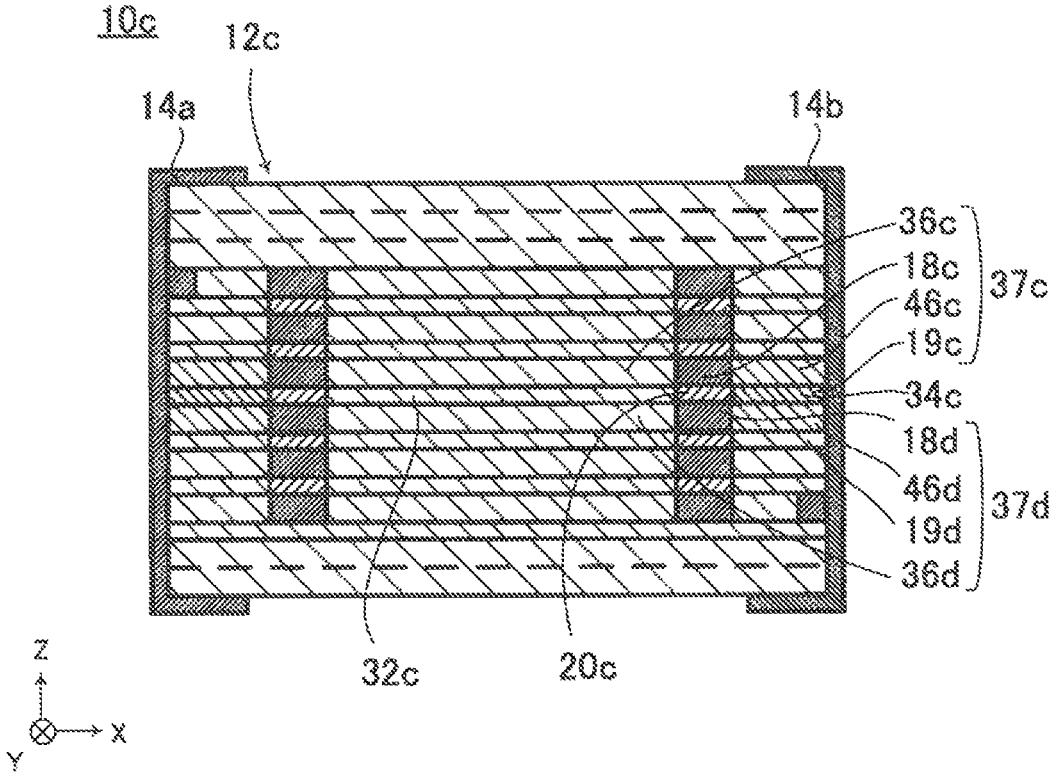
FIG. 7 is a sectional structural view of an electronic component according to a second exemplary modification.

An exemplary electronic component 10*c* and an exemplary manufacturing method for the same according to a second exemplary modification will now be described with reference to the drawing. FIG. 7 is a sectional structural view of the electronic component 10*c* according to the second modification. For the sake of simplicity of the drawing, some of reference symbols denoting the same components as those in FIG. 3 are not shown in FIG. 7.

The electronic component 10*c* differs from the electronic component 10*a* in that, in the electronic component 10*c*, second insulator layers 36*c* and 36*d* and third insulator layers 46*c* and 46*d*, where each of the third insulator layers 46*c* and 46*d* have a second Bi content rate lower than the first Bi content rate and a third Ni content rate higher than the first Ni content rate, are provided instead of the second insulator layers 16*c* and 16*d*, which are magnetic layers.

Here, the second insulator layer 36*c* and the third insulator layer 46*c*, and the second insulator layer 36*d* and the third insulator layer 46*d* are formed on or provided on portions of the first insulator layers 19*c* and 19*d* other than the coil conductors 18*c* and 18*d*, respectively.

More specifically, the third insulator layers 46*c* and 46*d* are formed on portions of the respective ceramic green sheets, which are to be the first insulator layers 19*c* and 19*d*, on the outer side of the coil conductors 18*c* and 18*d*. The second insulator layers 36*c* and 36*d* are formed on portions of the respective ceramic green sheets, which are to be the first insulator layers 19*c* and 19*d*, on the inner side of the coil conductors 18*c* and 18*d*.

Principal surfaces of the first insulator layers 19*c* and 19*d* are covered with the second insulator layers 36*c* and 36*d*, the third insulator layers 46*c* and 46*d*, and the coil conductors 18*c* and 18*d*. Further, corresponding respective principal surfaces of the second insulator layers 36*c* and 36*d*, the third insulator layers 46*c* and 46*d*, and the coil conductors 18*c* and 18*d* individually constitute one plane, and they are flush with each other. Moreover, the thickness of each of the first insulator layers 19*c* and 19*d* is smaller than that of each of the second insulator layers 36*c* and 36*d* and the third insulator layers 46*c* and 46*d*.

In the electronic component 10*c* according to the second modification, during the firing, Ni is diffused into the first insulator layer 19*c* from the third insulator layers 46*c* and 46*d*.

In more detail, as illustrated in FIG. 7, because a third portion 34*c* of the first insulator layer 19*c* (i.e., a portion of the first insulator layer 19*c* sandwiched between the third insulator layer 46*c* and the third insulator layer 46*d*) is contacted with the third insulator layers 46*c* and 46*d*, Ni is diffused into the third portion 34*c* from the third insulator layers 46*c* and 46*d*.

However, an amount of Ni diffused into the third portion 34*c* from the third insulator layers 46*c* and 46*d* is smaller than that diffused into the first insulator layer 19*c* from the second insulator layers 36*c* and 36*d*.

As described above, the reason that a smaller amount of Ni diffuses into the third portion 34*c* is that Bi has a very important role in the diffusion of Ni, and Bi contributes to promoting the diffusion of Ni. On the other hand, the Bi content rate in each of the third insulator layers 46*c* and 46*d* is lower than that in each of the second insulator layers 36*c* and 36*d*. Therefore, the amount of Ni diffused into the third portion 34*c* of the first insulator layer 19*c* is reduced.

Accordingly, the third portion 34*c* contains Ni in such a small amount as to not exhibit magnetism and becomes a non-magnetic layer, or a non-magnetic layer containing Ni only in surface layer portions positioned very close to both surfaces thereof, which are contacted with the third insulator layers 46*c* and 46*d*.

Here, the Ni content rate in the third portion 34*c* is lower than that in each of the second portions 22*a*, 22*b*, 22*d*, 22*e*, 22*f*, and 32*c*, and is also lower than that in each of the third insulator layers 46*c* and 46*d*. The second portion 32*c* is a portion sandwiched between the second insulator layers 36*c* and 36*d* of the first insulator layer 19*d*.

Consequently, in the electronic component 10*c*, the third portion 34*c* serving as the non-magnetic layer is formed on or provided on the outer side of the coil L. This allows the magnetic flux $\phi$1 to pass through the third portion 34*c* that is the non-magnetic layer. As a result, in the electronic component 10*c*, the occurrence of the magnetic saturation due to the magnetic flux $\phi$1 is suppressed.

As an exemplary manufacturing method for the electronic component 10*c*, respective ceramic pastes for ceramic paste layers to be the second insulator layers 36*c* and 36*d* and the third insulator layers 46*c* and 46*d* are first prepared. In practice, the respective ceramic pastes can be prepared in similar manners to those for preparing the ceramic paste for the second insulator layers 16*c* and 16*d* and the ceramic paste for the third insulator layers 26*c* and 26*d*. Hence, the description of the manners for preparing the ceramic pastes is not repeated here.

Next, the via hole conductors b3 and b4 are formed in the respective ceramic green sheets to be the first insulator layers 19*c* and 19*d*. Since a method of forming the via hole conductors b3 and b4 has been described above, the description of the method is not repeated here.

Next, the coil conductors 18*c* and 18*d* are formed on the respective ceramic green sheets to be the first insulator layers 19*c* and 19*d*. Since a method of forming the coil conductors 18*c* and 18*d* has been described above, the description of the method is not repeated here.

Next, the ceramic paste layers to be the second insulator layers 36*c* and 36*d* and the ceramic paste layers to be the third insulator layers 46*c* and 46*d* are formed on portions of the respective ceramic green sheets, which are to be the first insulator layers 19*c* and 19*d*, other than the coil conductors 18*c* and 18*d*.

More specifically, the third insulator layers 46*c* and 46*d* are formed on portions of the respective ceramic green sheets, which are to be the first insulator layers 19*c* and 19*d*, on the outer side of the coil conductors 18*c* and 18*d*, and the second insulator layers 36*c* and 36*d* are formed on portions of the respective ceramic green sheets, which are to be the first insulator layers 19*c* and 19*d*, on the inner side of the coil conductors 18*c* and 18*d*.

Thus, the ceramic paste layers to be the second insulator layers 36*c* and 36*d* and the third insulator layers 46*c* and 46*d* are formed by coating the above-mentioned ceramic pastes with screen printing or some other suitable method.

Ceramic green layers to be third unit layers 37*c* and 37*d* are formed through the above-described steps.

Next, the ceramic green sheets to be the exterior insulator layers 15*a* to 15*c*, the ceramic green layers to be the first unit layers 17*a* to 17*b*, the third unit layers 37*c* and 37*d*, and the first unit layers 17*e* to 17*f*, and the ceramic green sheets to be the exterior insulator layers 15*d* and 15*e* are successively laminated in the order named and press-bonded, whereby an unfired mother laminate is obtained. The other steps in the method of manufacturing the electronic component 10*c* are similar to those in the method of manufacturing the electronic component 10*a*, and hence the description of the other steps is not repeated here.

Figure 8:
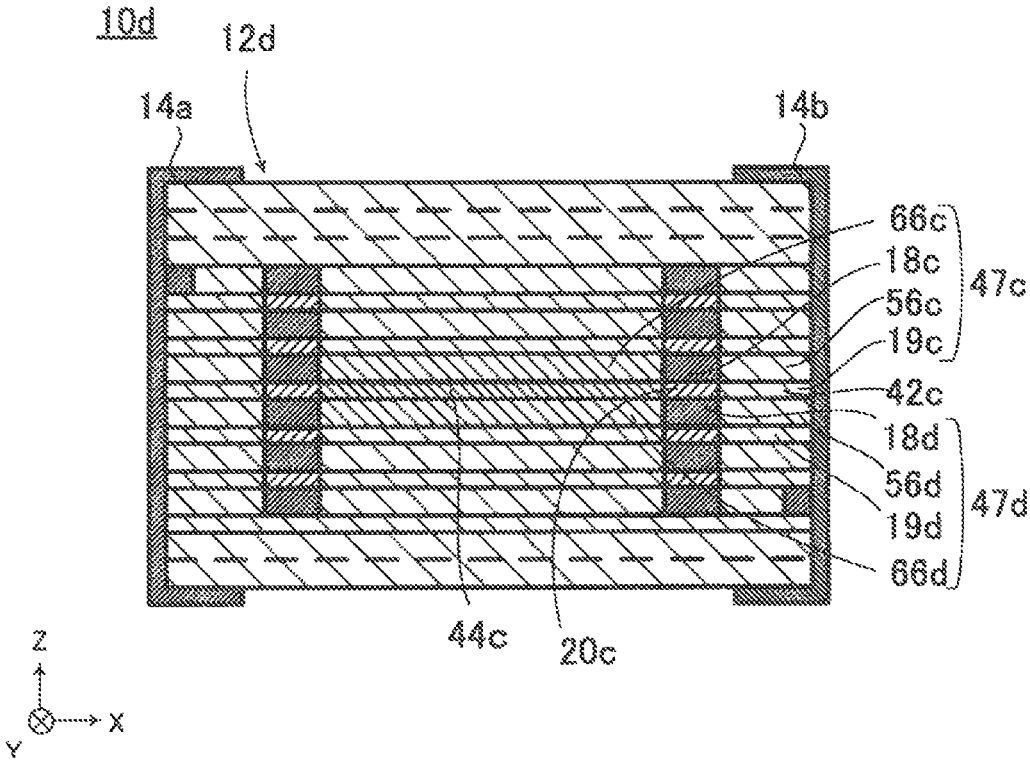
FIG. 8 is a sectional structural view of an electronic component according to a third exemplary modification.

An exemplary electronic component 10*d* and an exemplary manufacturing method for the same according to a third exemplary modification will be described with reference to the drawing. FIG. 8 is a sectional structural view of the electronic component 10*d* according to the third modification. For the sake of simplicity of the drawing, some of reference symbols denoting the same components as those in FIG. 3 are not shown in FIG. 8.

The electronic component 10*d* differs from the electronic component 10*a* in that, in the electronic component 10*d*, second insulator layers 56*c* and 56*d* and the third insulator layers 66*c* and 66*d*, where each of the third insulator layers 66*c* and 66*d* having a second Bi content rate lower than the first Bi content rate and a third Ni content rate higher than the first Ni content rate, are provided instead of the second insulator layers 16*c* and 16*d*, which are magnetic layers.

Here, the second insulator layer 56*c* and the third insulator layer 66*c*, and the second insulator layer 56*d* and the third insulator layer 66*d* are formed or provided on portions of the first insulator layers 19*c* and 19*d* other than the coil conductors 18*c* and 18*d*, respectively.

More specifically, the third insulator layers 66*c* and 66*d* are formed on or provided on portions of the respective ceramic green sheets, which are to be the first insulator layers 19*c* and 19*d*, on the inner side of the coil conductors 18*c* and 18*d*. The second insulator layers 56*c* and 56*d* are formed on or provided on portions of the respective ceramic green sheets, which are to be the first insulator layers 19*c* and 19*d*, on the outer side of the coil conductors 18*c* and 18*d*.

Principal surfaces of the first insulator layers 19*c* and 19*d* are covered with the second insulator layers 56*c* and 56*d*, the third insulator layers 66*c* and 66*d*, and the coil conductors 18*c* and 18*d*. Further, corresponding respective principal surfaces of the second insulator layers 56*c* and 56*d*, the third insulator layers 66*c* and 66*d*, and the coil conductors 18*c* and 18*d* individually constitute one plane, and they are flush with each other. Moreover, the thickness of each of the first insulator layers 19*c* and 19*d* is smaller than that of each of the second insulator layers 56*c* and 56*d* and the third insulator layers 66*c* and 66*d*.

In the electronic component 10*d* according to the third modification, during the firing, Ni is diffused into the first insulator layer 19*c* from the third insulator layers 66*c* and 66*d*.

In more detail, as illustrated in FIG. 8, because a third portion 44*c* of the first insulator layer 19*c* (i.e., a portion of the first insulator layer 19*c* sandwiched between the third insulator layer 66*c* and the third insulator layer 66*d*) is contacted with the third insulator layers 66*c* and 66*d*, Ni is diffused into the third portion 44*c* from the third insulator layers 66*c* and 66*d*.

However, an amount of Ni diffused into the third portion 44*c* from the third insulator layers 66*c* and 66*d* is smaller than that diffused into the first insulator layer 19*c* from the second insulator layers 56*c* and 56*d*.

As described above, the reason that a smaller amount of Ni diffuses into the third portion 44*c* is that Bi has a very important role in the diffusion of Ni, and Bi contributes to promoting the diffusion of Ni. On the other hand, the Bi content rate in each of the third insulator layers 66*c* and 66*d* is lower than that in each of the second insulator layers 56*c* and 56*d*. Therefore, the amount of Ni diffused into the third portion 44*c* of the first insulator layer 19*c* is reduced.

Accordingly, the third portion 44*c* becomes a non-magnetic layer containing Ni in such a small amount as not exhibiting magnetism, or a non-magnetic layer containing Ni only in surface layer portions positioned very close to both surfaces thereof, which are contacted with the third insulator layers 66*c* and 66*d*.

Here, the Ni content rate in the third portion 44*c* is lower than that in each of the second portions 22*a*, 22*b*, 22*d*, 22*e*, 22*f*, and 42*c*, and is also lower than that in each of the third insulator layers 66*c* and 66*d*. The second portion 42*c* is a portion sandwiched between the second insulator layers 56*c* and 56*d* of the first insulator layer 19*c*.

Consequently, in the electronic component 10*d*, the third portion 44*c* serving as the non-magnetic layer is formed on the inner side of the coil L. This allows the magnetic flux $\phi$1 to pass through the third portion 44*c* that is the non-magnetic layer. As a result, in the electronic component 10*d*, the occurrence of the magnetic saturation due to the magnetic flux $\phi$1 is suppressed.

As an exemplary manufacturing method for the electronic component 10*d*, respective ceramic pastes for ceramic paste layers to be the second insulator layers 56*c* and 56*d* and the third insulator layers 66*c* and 66*d* are first prepared. In practice, the respective ceramic pastes can be prepared in similar manners to those for preparing the ceramic paste for the second insulator layers 16*c* and 16*d* and the ceramic paste for the third insulator layers 26*c* and 26*d*. Hence, the description of the manner for preparing the ceramic pastes is not repeated here.

Next, the via hole conductors b3 and b4 are formed in the respective ceramic green sheets to be the first insulator layers 19*c* and 19*d*. Since a method of forming the via hole conductors b3 and b4 has been described above, the description of the method is not repeated here.

Next, the coil conductors 18*c* and 18*d* are formed on the respective ceramic green sheets to be the first insulator layers 19*c* and 19*c*. Since a method of forming the coil conductors 18*c* and 18*d* has been described above, the description of the method is not repeated here.

Next, the ceramic paste layers to be the second insulator layers 56*c* and 56*d* and the ceramic paste layers to be the third insulator layers 66*c* and 66*d* are formed on portions of the respective ceramic green sheets, which are to be the first insulator layers 19*c* and 19*d*, other than the coil conductors 18*c* and 19*d*.

More specifically, the third insulator layers 66*c* and 66*d* are formed on portions of the respective ceramic green sheets, which are to be the first insulator layers 19*c* and 19*d*, on the inner side of the coil conductors 18*c* and 18*d*, and the second insulator layers 56*c* and 56*d* are formed on portions of the respective ceramic green sheets, which are to be the first insulator layers 19*c* and 19*d*, on the outer side of the coil conductors 18*c* and 18*d*.

Thus, the ceramic paste layers to be the second insulator layers 56*c* and 56*d* and the third insulator layers 66*c* and 66*d* are formed by coating the above-mentioned ceramic pastes with screen printing or some other suitable method.

Ceramic green layers to be third unit layers 47*c* and 47*d* are formed through the above-described steps.

Next, the ceramic green sheets to be the exterior insulator layers 15*a* to 15*c*, the ceramic green layers to be the first unit layers 17*a* to 17*b*, the third unit layers 47*c* and 47*d*, and the first unit layers 17*e* to 17*f*, and the ceramic green sheets to be the exterior insulator layers 15*d* and 15*e* are successively laminated in the order named and press-bonded, whereby an unfired mother laminate is obtained. The other steps in the method of manufacturing the electronic component 10*d* are similar to those in the method of manufacturing the electronic component 10*a*, and hence the description of the other steps is provided above.

It is to be noted that, while the electronic components 10*a* to 10*d* are each manufactured by a sequential press-bonding process, the electronic component may be manufactured by a printing process as another example.

Further, while the first to third exemplary modifications of the present invention illustrate examples in which the non-magnetic layer is formed in one or more portions of the first insulator layer 19*c*, the non-magnetic layer may be formed in the first insulator layer 19*a*, 19*b*, 19*d*, 19*e* or 19*f* other than the first insulator layer 19*c* by using similar means to those described above. Moreover, the electronic component may be manufactured in combination of the first to third modifications such that the non-magnetic layers are formed in plural of the first insulator layers 19*a* to 19*f*.

With the electronic component according to the present disclosure, the occurrence of magnetic saturation due to magnetic fluxes circling around the individual coil conductors can be suppressed, and a fall of an inductance value during supply of a current can be reduced.

Further, with the manufacturing method for the electronic component according to the present disclosure, a non-magnetic layer sandwiched between the coil conductors from both sides in the lamination direction can be formed with high accuracy.

Embodiments consistent with the present disclosure are usefully applied to an electronic component and a manufacturing method for the electronic component. In particular, embodiments consistent with the present disclosure are superior in an ability of suppressing the occurrence of the magnetic saturation due to the magnetic fluxes circling around the individual coil conductors.

That which is claimed is:

1. An electronic component including a plurality of first unit layers, each comprising a first insulator layer in form of a sheet, a coil conductor formed on the first insulator layer, and a second insulator layer formed on a portion of the first insulator layer other than the coil conductor, wherein a helical coil is constituted with the first unit layer laminated in plural and with the coil conductor connected in plural to each other, and wherein, given that a portion of the first insulator layer, the portion positioned in contact with and sandwiched between the coil conductors from both sides facing in a lamination direction, is a first portion, and a portion of the first insulator layer, the portion being sandwiched between the second insulator layers from both sides facing in the lamination direction, is a second portion, a nickel content rate in the first portion is lower than a nickel content rate in the second portion, and the nickel content rate in the second portion is lower than a nickel content rate in the second insulator layer.

2. The electronic component according to claim 1, wherein the electronic component further includes a second unit layer comprising another first insulator layer in form of a sheet, a coil conductor formed on the first insulator layer, and a third insulator layer formed on a portion of the another first insulator layer other than the coil conductor, wherein a helical coil is constituted with the first unit layer and the second unit layer laminated and with the coil conductor connected in plural to each other, and wherein, given that a portion of the first insulator layer, the portion being sandwiched between the third insulator layers from both sides in the lamination direction, is a third portion, a nickel content rate in the third portion is lower than the nickel content rate in the second portion and is lower than a nickel content rate in the third insulator layer.

3. The electronic component according to claim 1, wherein the electronic component further includes a third unit layer comprising another first insulator layer in form of a sheet, a coil conductor formed on the another first insulator layer, and another second insulator layer and a third insulator layer which are formed on portions of the first insulator layer other than the coil conductor, wherein a helical coil is constituted with the first unit layer and the third unit layer laminated and with the coil conductor connected in plural to each other, and wherein, given that a portion of the first insulator layer, the portion being sandwiched between the third insulator layers from both sides in the lamination direction, is a third portion, a nickel content rate in the third portion is lower than the nickel content rate in the second portion and is lower than a nickel content rate in the third insulator layer.

* * * * *